US005141225A

United States Patent [19]

Fulkerson

[11] Patent Number: 5,141,225

[45] Date of Patent: Aug. 25, 1992

[54] BILLIARDS AND POOL CUE GUIDE

[76] Inventor: Randall W. Fulkerson, 2419 Anne Dr., Henderson, Ky. 42420

[21] Appl. No.: 563,528

[22] Filed: Aug. 6, 1990

[51] Int. Cl.[5] ..... A63D 15/10
[52] U.S. Cl. ..... 273/24
[58] Field of Search ..... 273/14, 23, 24

[56] References Cited

U.S. PATENT DOCUMENTS

| | | | |
|---|---|---|---|
| 154,784 | 9/1874 | Bogia | 273/33 |
| 1,149,834 | 8/1915 | James | 273/24 |
| 3,220,122 | 11/1965 | Miller | 273/14 |
| 3,463,593 | 8/1969 | Horan | 273/14 |
| 3,544,111 | 12/1970 | Crisman | 273/24 |
| 3,563,543 | 2/1971 | Hamilton et al. | 273/23 |
| 4,210,325 | 7/1980 | McCan | 273/24 |

FOREIGN PATENT DOCUMENTS

| | | | |
|---|---|---|---|
| 1978 of 1906 | | United Kingdom | 273/24 |
| 190635 | 12/1922 | United Kingdom | 273/33 |

*Primary Examiner*—Theatrice Brown
*Attorney, Agent, or Firm*—Warren D. Flackbert

[57] ABSTRACT

A playing aid for a game such as pool and/or billiards in the form of a lightweight molded plastic resin presenting troughs and ridges into which the fingers and thumb of the player are introduced and including a directional arrow for proper playing orientation. A flexible member is provided for detachably retaining the device on the player's hand. The aid importantly provides position conformity to the player, as, for example, in dictating an open bridge, a closed bridge and an elevated bridge, as selectively required by a player in the course of a game.

8 Claims, 2 Drawing Sheets

BILLIARDS AND POOL CUE GUIDE

BACKGROUND OF THE INVENTION

As is known, interest in playing the games of pool and billiards is widespread and ever increasing. In order to achieve optimal playing ability, however, it is important that one of the player's hands assumes variously defined professional bridge forms, identified as an open bridge, a closed bridge and an elevated bridge useful for completing an over a ball shot.

Until the presentation of the invention herein, conformity in achieving the preceding bridges was mostly unsuccessful and, thus, reflected on the player's ability.

DESCRIPTION OF THE INVENTION

The invention overcomes the preceding difficulty by presenting a playing aid or bridge developed to be received on the surface of a pool, billiard and/or snooker table beneath the player's hand and, importantly, includes a directional pointer or arrow for continual proper placement. The game playing aid of the invention reflects a particular configuration adapted to receive the fingers and thumb of a player's hand, assuring consistent placement of such during the game. An elastic member is provided to positively place the aid on the player's hand.

Typically, the game playing aid herein is formed from a plastic resin, is light in weight, is readily positioned at a use location on the playing surface of the table, is decorative, as desired, and may be either right-handed or left-handed.

DESCRIPTION OF THE FIGURES

A better understanding of the present invention will become more apparent from the following description, taken in conjunction with the accompanying drawing, wherein.

Figure 1:
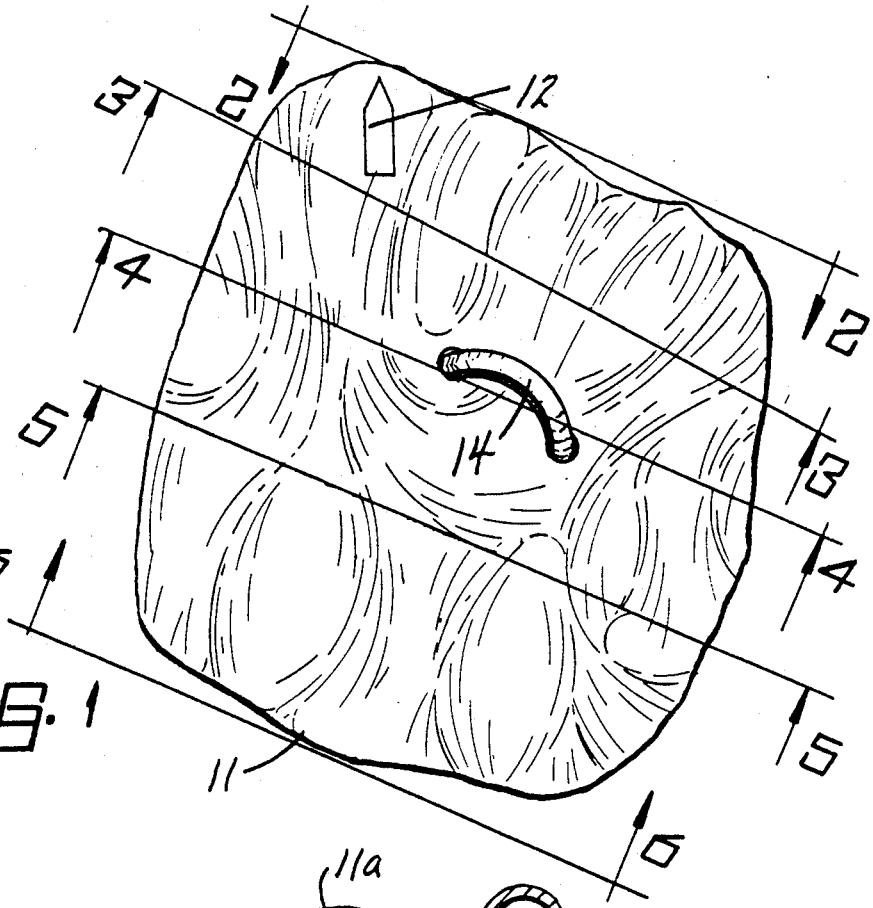
FIG. 1 is a top plan view of a game playing aid in accordance with the teachings of the present invention.
Figure 2:
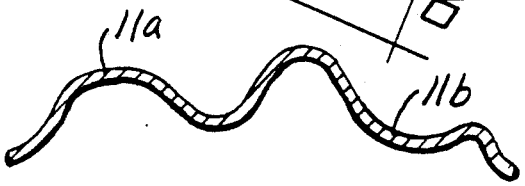
FIG. 2 to 6, inclusive, are views in vertical section respectively taken at line 2—2, 3—3, 4—4, 5—5, and 6—6 on FIG. 1, looking in the direction of the arrows, detailing the contour of the surface on which the player's hand rests.
Figure 3:
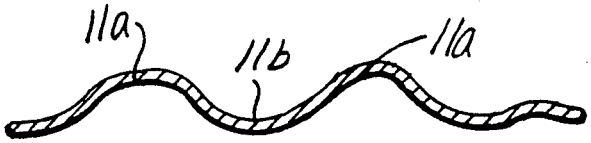
Figure 4:
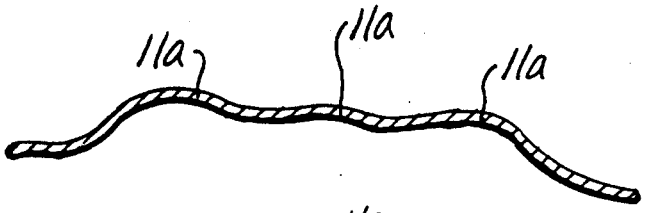
Figure 5:
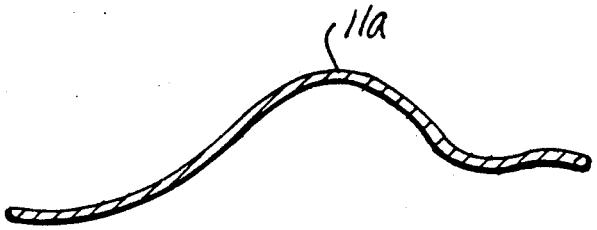
Figure 6:
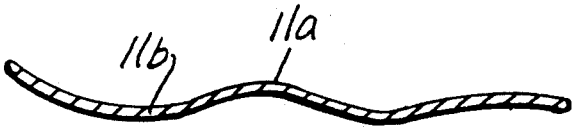

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF THE PREFERRED EMBODIMENT

Referring now to the FIGURES, and particularly FIGS. 1 to 6, inclusive, the finalized contour of the instant game playing aid is quite significant in achieving proper finger and thumb placement. Thus, body 11 of the aid is arranged with a series of generally parallel extending ridges 11*a* and troughs 11*b* to selectively receive and position the respective fingers, and thumb, to satisfy, for example, the particular playing bridges illustrated in FIGS. 7, 8 and 9.

Figure 7:
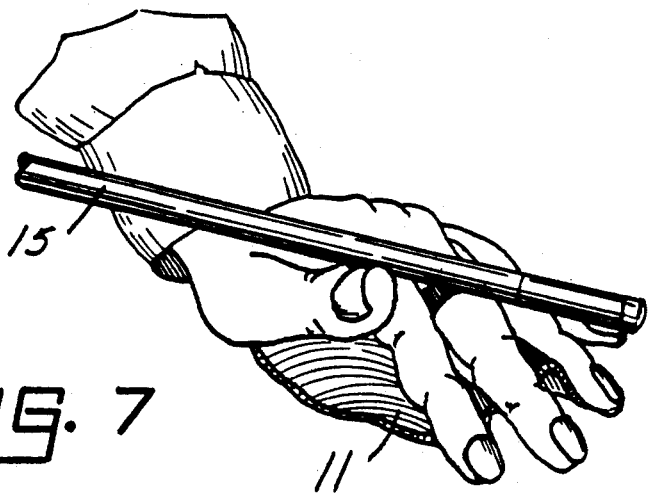
FIG. 7 is a perspective view showing use of the invention at what is deemed an open bridge.

In other words, and restated, the aforesaid ridges 11*a* and troughs 11*b* establish paths for finger and thumb positioning, where, for example, and looking at FIG. 7, an open bridge is presented showing the thumb bearing against the side of the index finger and defining a space thereabove for receiving cue stick 15.

Figure 8:
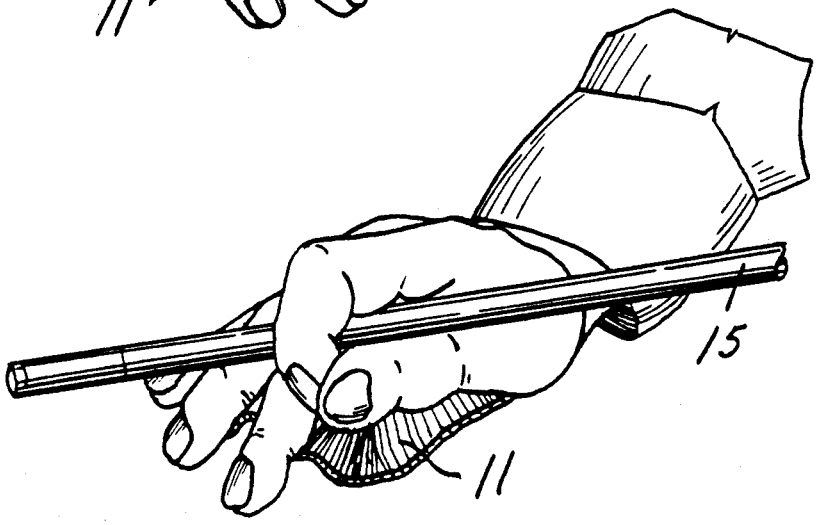
FIG. 8 is another perspective view showing use of the invention at what is deemed a closed bridge; and, FIG. 9 is yet another perspective view showing use of the invention at what is deemed an elevated bridge (for an over a ball shot).
Figure 9:
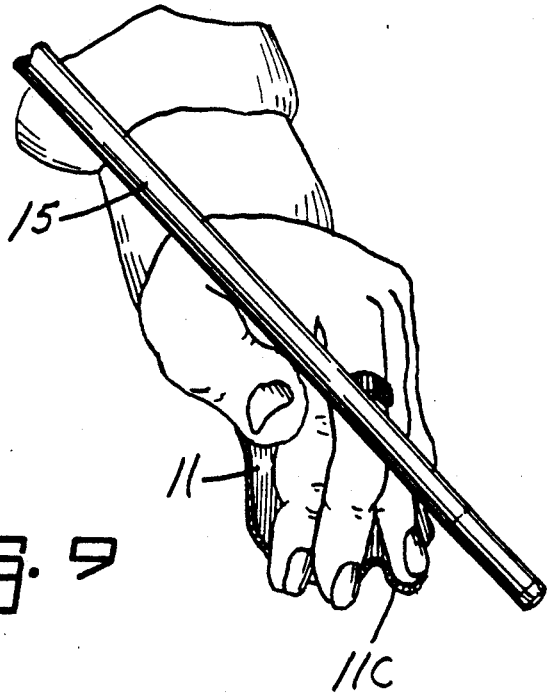

In FIG. 8, the arrangement of such is that the index finger and the thumb create an opening therebetween adapted to receive the cue stick 15.

The arrangement of claim 9 shows body 11 of the playing aid resting on the front edge 11*c* thereof, a particularly significant bridge depending upon cue ball location. The cue stick 15 rides along a passage established between the thumb and the index finger, but elevated above the playing surface (in contrast to the open bridge of FIG. 7).

Importance lies in connection with the directional arrow, identified by reference numeral 12, on the upper surface of the body 11 of the instant game playing aid. The aforesaid arrow indicates the position in which the aid should be oriented to achieve desired optimal performance. The arrow 12 generally signifies the location of the player's hand at a 45° angle with respect to the cue stick 15. Further, an elastic band 14 may be provided for retaining the aid on the player's hand.

It should be evident that the invention serves importance in instruction and usage, particularly in establishing conformity of position for various types of bridges. If the player properly follows the guides presented by the invention, a uniformity in shot placement is created, resulting in an improved game on the part of the player.

The game playing aid described hereabove is susceptible to various changes within the spirit of the invention, including, for example, overall proportioning, but where the disclosed surface configuration should be relatively maintained; the particular manner of securing the aid to the hand of the player; any ornamentation on the directional arrow; the choice of material defining the unit, other than the mentioned molded plastic resin; and, the like. Thus, the preceding should be considered illustrative and not as limiting the scope of the following claims.

I claim:

1. A pool cue bridge for simultaneous cooperating with the palm, fingers and thumb of a hand of a player comprising, a rigid body of predetermined width and height, and having an upper surface of troughs and ridges adapted to selectively and directly receive said palm, fingers and said thumb of a player in an uncovered relationship and in all preselected bridge oriented positions, whereby a cue stick can be selectively overlaid and in contact only with said fingers and thumb of a players hand while the palm of the hand is engaged with a portion of said bridge; and means on the upper surface of said bridge for detachably securing said bridge to a hand of a player.

2. The playing aid of claim 1 where said troughs and ridges are generally parallel.

3. The playing aid of claim 1 where said preselected bridge position is defined as open.

4. The playing aid of claim 1 where said preselected bridge position is defined as closed.

5. The playing aid of claim 1 where said preselected bridge position is defined as elevated.

6. The playing aid of claim 5 where said body portion includes a front edge serving a load bearing relationship at said preselected bridge position.

7. The playing aid of claim 1 where said body portion includes a directional arrow for aiding orientation of a players hand on said bridge, and where a cue stick can be disposed parallel therewith.

8. The playing aid of claim 1 where said body portion is fabricated from a molded plastic resin.

* * * * *